US011492982B1

(12) United States Patent
Squires

(10) Patent No.: US 11,492,982 B1
(45) Date of Patent: Nov. 8, 2022

(54) PIPE EXHAUST CUT-OUTS

(71) Applicant: Kasey Squires, Battleground, WA (US)

(72) Inventor: Kasey Squires, Battleground, WA (US)

( * ) Notice: Subject to any disclaimer, the term of this patent is extended or adjusted under 35 U.S.C. 154(b) by 0 days.

(21) Appl. No.: 17/698,726

(22) Filed: Mar. 18, 2022

(51) Int. Cl.
*F02D 9/04* (2006.01)
*F02D 9/10* (2006.01)

(52) U.S. Cl.
CPC ..... *F02D 9/1025* (2013.01); *F02D 9/04* (2013.01); *F02D 9/1085* (2013.01)

(58) Field of Classification Search
CPC ..... F02D 9/1025; F02D 9/094; F02D 9/1085; F02D 9/1065; F02D 9/101; F02D 9/1055; F01N 3/2892; F01N 13/08; F01N 2240/20; F01N 2240/36; F02B 27/06; F02M 26/66; F02M 26/70; F02M 26/54; F02M 26/26
See application file for complete search history.

(56) References Cited

U.S. PATENT DOCUMENTS 1,496,915 A * 6/1924 Weir ..... F01N 13/087 251/360
5,452,578 A * 9/1995 Barber ..... F01N 13/087 181/254
6,584,767 B1 * 7/2003 Koenig ..... F02D 9/04 137/869
7,814,748 B2 * 10/2010 Nydam ..... F02M 26/26 60/292
9,556,790 B2 * 1/2017 McCord ..... F01N 13/082
2008/0072865 A1 * 3/2008 Balsdon ..... F02M 26/26 123/190.2

* cited by examiner

*Primary Examiner* — Audrey B. Walter
*Assistant Examiner* — Dapinder Singh
(74) *Attorney, Agent, or Firm* — Bruce A. Lev

(57) ABSTRACT

An improved pipe exhaust cut-out that is adapted to be controllably opened and completely closed thereby sealing the exhaust pipe cut-out. The improved pipe exhaust cut-out incorporates a remotely controlled linear actuator.

20 Claims, 4 Drawing Sheets

PIPE EXHAUST CUT-OUTS

BACKGROUND OF THE INVENTION

1. Field of the Invention

This invention relates generally to pipe exhaust cut-outs, and more specifically to pipe exhaust cut-outs for automobile exhaust systems.

2. Description of the Related Art

Prior art pipe exhaust cut-outs rely solely on pivoting internal pipe baffles that do not completely seal and thereby notoriously leak exhaust therethrough. Leaking exhaust pipes result in reduced mechanical engine compression and thereby reduces the power output of the mechanical engine. Furthermore, leaking exhaust pipes and pipe exhaust cut-outs produce unwanted pollution and noise. Accordingly, the present invention overcomes these disadvantages associated with the prior art by providing an improved pipe exhaust cut-out that is adapted to controllably open and completely close and thereby seal the exhaust pipe cut-out.

BRIEF SUMMARY OF THE INVENTION

In view of the foregoing disadvantages inherent in the known types of exhaust pipe cut-outs, or the like in the prior art, the present invention provides an improved exhaust pipe cut-out. As such, the general purpose of the present invention, which will be described subsequently in greater detail, is to provide an improved pipe exhaust cut-out that is adapted to be controllably opened and completely closed and thereby seal the exhaust pipe cut-out with all the advantages of the prior art and none of the disadvantages.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

The figures which accompany the written portion of this specification illustrate embodiments according to the teachings of the present invention.

The various embodiments of the present invention will hereinafter be described in conjunction with the appended drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

Figure 1:
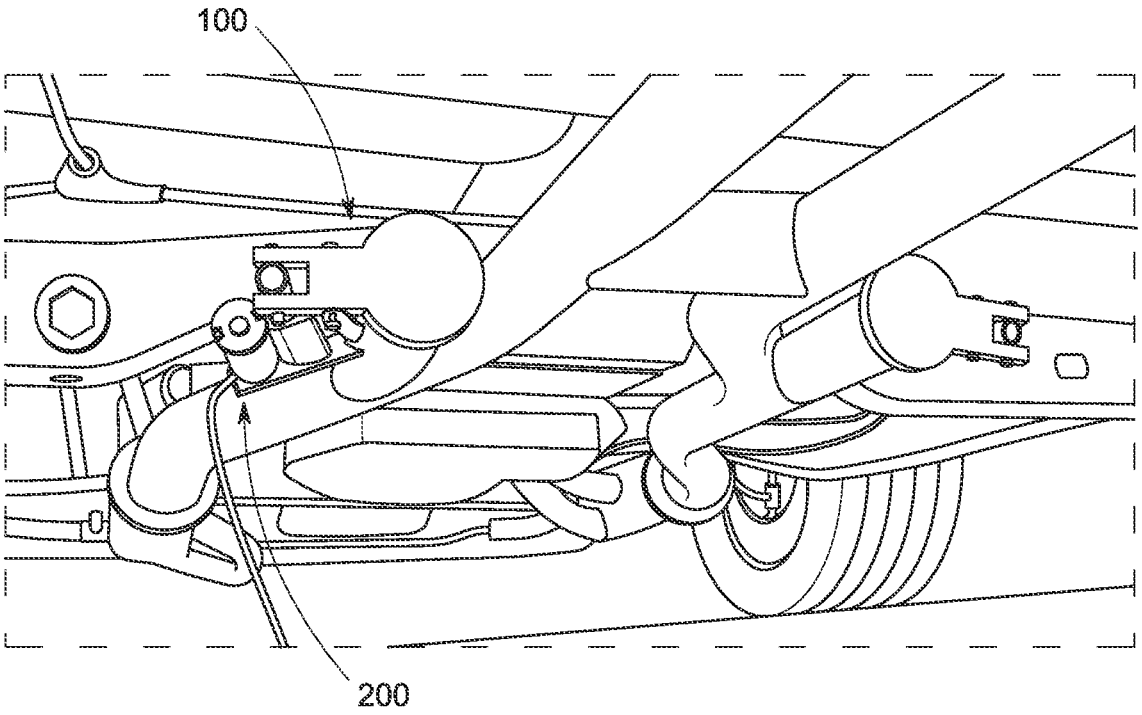
FIG. 1 shows a perspective view of the improved pipe exhaust cut-out in a closed configuration according to the preferred embodiment of the present invention.
Figure 2:
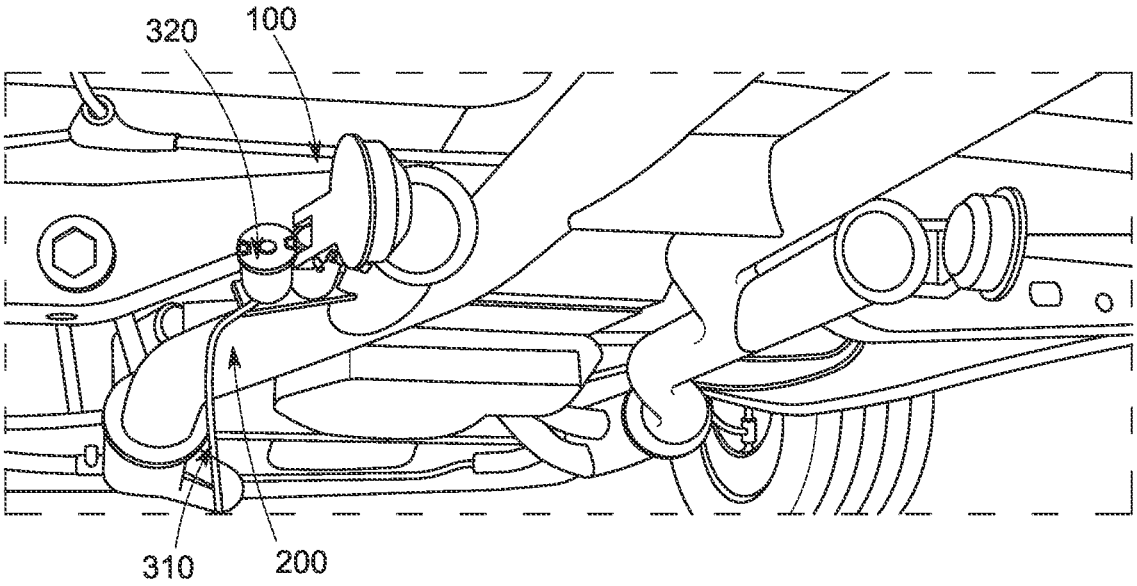
FIG. 2 shows a perspective view of the improved pipe exhaust cut-out in an open configuration according to the preferred embodiment of the present invention of FIG. 1.
Figure 3:
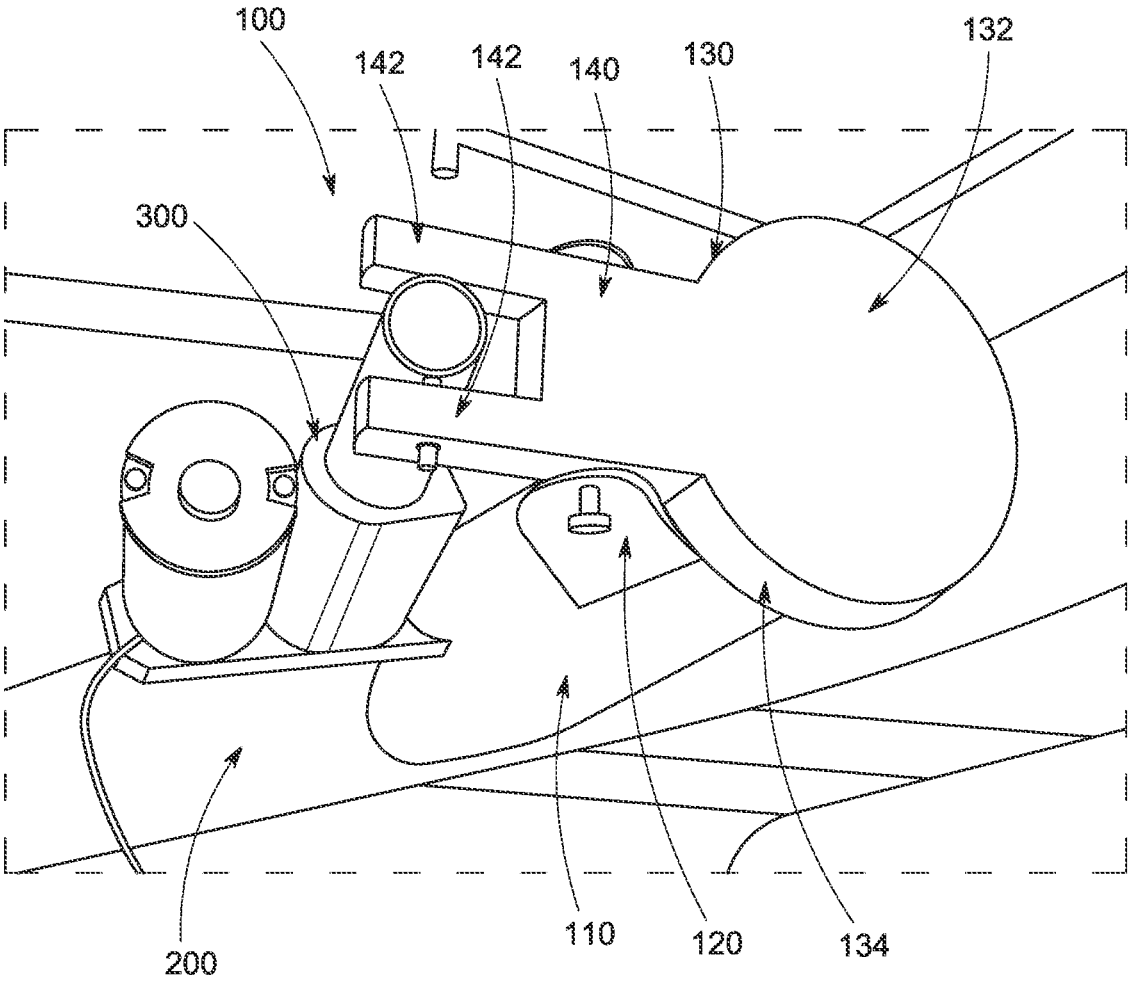
FIG. 3 shows a close-up perspective view of the improved pipe exhaust cut-out in a closed configuration according to the preferred embodiment of the present invention of FIG. 1.

Turning now descriptively to FIGS. 1-4, the present invention discloses a pipe exhaust cut-out 100 that is adapted to be connected to an automobile exhaust pipe 200. The pipe exhaust cut-out 100 comprises a main pipe 110 having an elongated tubular body, a proximal end adapted to be connected to the automobile exhaust pipe 200, a distal end, an inner surface, an outer surface, and a hinge portion 120 connected adjacent to said distal end; a flapper 130 including a main body portion 132 having a periphery extending around the automobile main body portion, a rim 134 extending around the periphery of the main body portion, wherein the rim includes a beveled edge 136 formed upon its entire length and is adapted to contact the distal end of the main pipe 110, and wherein the main body portion 132 of the flapper 132 is shaped and adapted to removably cover and seal the distal end of the main pipe 110; and a hinge portion 140 including a proximal end attached to the main body portion 132, a middle section adapted to pivotally connect with the hinge portion 120 of the main pipe, and a distal end, wherein the hinge portion 140 is attached to and extends from the main body portion 132 adjacent to the periphery; and an actuator 300 adapted to be connected between the elongated tubular body of the main pipe 110, or the exhaust pipe 200 of an automobile, and the distal end of the hinge portion 140 of the flapper 130, such that the actuator 300 can pivot the flapper 130 between an open position with respect to the distal end of the main pipe, as shown in FIG. 2, and a closed position with respect to the distal end of the main pipe, as shown in FIG. 1. The vehicle exhaust pipe 200 is further adapted to be cut thereby forming a hole in its elongated tubular body, wherein the proximal end of the pipe exhaust cut-out 100 is adapted to be connected to the vehicle exhaust pipe, and surrounding the hole, to thereby allow exhaust from the vehicle exhaust pipe to pass into and controllably out of the pipe exhaust cut-out 100.

Figure 4B:
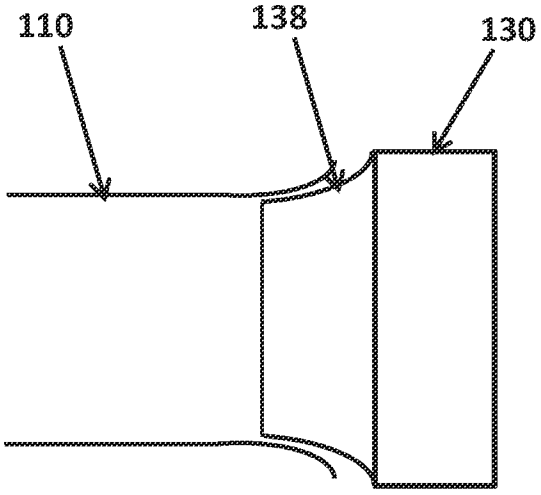
FIG. 4*b* shows a cross-sectional view of a second embodiment of the elongated tubular body and flapper of the improved pipe exhaust cut-out in a closed configuration according to the preferred embodiment of the present invention of FIG. 1.
Figure 4A:
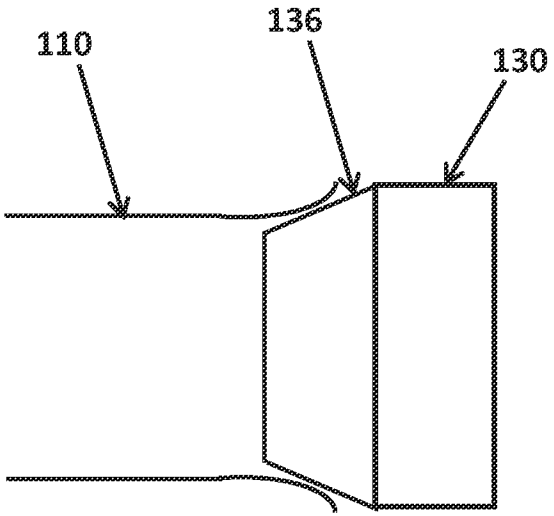
FIG. 4*a* shows a cross-sectional view of a first embodiment of the elongated tubular body and flapper of the improved pipe exhaust cut-out in a closed configuration according to the preferred embodiment of the present invention of FIG. 1.

The elongated tubular body 110 of the pipe exhaust cut-out may be formed having a cross-section that is cylindrical, and the main body portion 132 of said flapper 130 may also be formed having a cross-section that is cylindrical, to thereby match. The distal end of the main pipe 110 may also be flared outwardly, as shown in FIGS. 4*a* and 4*b*, wherein its inner surface is adapted to contact the beveled edge 136 of the rim of the main body portion of said flapper. The beveled edge of the rim may be formed at an angle to the rim between 10 and 70 degrees, and preferably 45 degrees. The beveled edge of the rim may also be formed having a curved cross section 138 adapted to match the curved shape of the flare of the distal end of the main pipe 110.

The actuator 300 may be formed as an electric linear actuator that includes an electric motor, and may further comprise a control wire 310 adapted to be connected between a controller and the actuator, such that the actuator can be controlled by the controller. The actuator 300 may also include a receiver 320 adapted to receive electronic signals from a transmitter, such that the actuator can be controlled remotely via the transmitter.

The distal end of the hinge portion 140 of the flapper 130 may be formed having two projections 142 and a space therebetween and adapted to allow the actuator 300 to be pivotally connected therebetween and within the space. Furthermore, the main pipe and the flapper may be formed from aluminum or stainless steel.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

What is claimed is:

1. A pipe exhaust cut-out comprising:
- a main pipe comprising:
  - an elongated tubular body;
  - a proximal end;
    - wherein said proximal end of said main pipe is adapted to be connected to an exhaust pipe of an automobile;
  - a distal end;
  - an inner surface;
  - an outer surface; and
  - a hinge portion;
    - wherein said hinge portion is connected adjacent to said distal end;
- a flapper including:
  - a main body portion including:
    - a periphery;
      - wherein said periphery extends around said main body portion; and
    - a rim including:
      - wherein said rim extends around said periphery of said main body portion; and
      - wherein said rim includes a beveled edge formed upon its entire length and is adapted to contact said distal end of said main pipe;
    - wherein said main body portion is shaped and adapted to removably cover and seal said distal end of said main pipe; and
  - a hinge portion including:
    - a proximal end:
      - wherein said proximal end is attached to said main body portion;
    - a middle section:
      - wherein said middle section is adapted to pivotally connect with said hinge portion of said main pipe; and
    - a distal end:
    - wherein said hinge portion is attached to and extends from said main body portion adjacent to said periphery of said main body portion; and
- an actuator:
  - wherein said actuator is adapted to be connected between said elongated tubular body of said main pipe, or said exhaust pipe of an automobile, and said distal end of said hinge portion of said flapper, such that said actuator can pivot said flapper between an open position with respect to said distal end of said main pipe and a closed position with respect to said distal end of said main pipe.

2. The pipe exhaust cut-out of claim 1, wherein said elongated tubular body is cylindrical; and wherein said main body portion of said flapper is cylindrical.

3. The pipe exhaust cut-out of claim 1, wherein said distal end of said main pipe is flared outwardly and said inner surface thereof is adapted to contact said beveled edge of said rim of said main body portion of said flapper.

4. The pipe exhaust cut-out of claim 3, wherein said beveled edge of said rim is formed having a curved cross section adapted to match the curved shape of the flare of said distal end of said main pipe.

5. The pipe exhaust cut-out of claim 1, wherein said actuator is formed as a linear actuator.

6. The pipe exhaust cut-out of claim 5, wherein said actuator is formed as an electric actuator that includes an electric motor.

7. The pipe exhaust cut-out of claim 1, further comprising a control wire adapted to be connected between a controller and said actuator, such that said actuator can be controlled by said controller.

8. The pipe exhaust cut-out of claim 1, wherein said actuator includes a receiver adapted to receive electronic signals from a transmitter, such that said actuator can be controlled remotely via said transmitter.

9. The pipe exhaust cut-out of claim 1, wherein said beveled edge of said rim is formed at an angle to said rim between 10 and 70 degrees.

10. The pipe exhaust cut-out of claim 9, wherein said beveled edge of said rim is formed at an angle to said rim of 45 degrees.

11. The pipe exhaust cut-out of claim 1, wherein said distal end of said hinge portion of said flapper is formed having two projections and a space therebetween and adapted to allow said actuator to be pivotally connected therebetween and within said space.

12. The pipe exhaust cut-out of claim 1, wherein said main pipe and said flapper are formed from a material chosen from a group of materials consisting of aluminum and stainless steel.

13. The pipe exhaust cut-out of claim 1, wherein said distal end of said hinge portion of said flapper is formed having two projections and a space therebetween and adapted to allow said actuator to be pivotally connected therebetween and within said space.

14. The combination of a vehicle exhaust pipe and a pipe exhaust cut-out, comprising:

an automobile exhaust pipe including:

an elongated tubular body; and a pipe exhaust cut-out comprising:

a main pipe comprising:

an elongated tubular body;

a proximal end;

wherein said proximal end of said main pipe is adapted to be connected to said automobile exhaust pipe;

a distal end;

an inner surface;

an outer surface; and a hinge portion;

wherein said hinge portion is connected adjacent to said distal end;

a flapper including:

a main body portion including:

a periphery;

wherein said periphery extends around said main body portion; and a rim including:

wherein said rim extends around said periphery of said main body portion; and wherein said rim includes a beveled edge formed upon its entire length and is adapted to contact said distal end of said main pipe;

wherein said main body portion is shaped and adapted to removably cover and seal said distal end of said main pipe; and a hinge portion including:

a proximal end:

wherein said proximal end is attached to said main body portion;

a middle section:

wherein said middle section is adapted to pivotally connect with said hinge portion of said main pipe; and a distal end:

wherein said hinge portion is attached to and extends from said main body portion adjacent to said periphery of said main body portion; and an actuator:

wherein said actuator is adapted to be connected between said elongated tubular body of said main pipe, or said automobile exhaust pipe, and said distal end of said hinge portion of said flapper, such that said actuator can pivot said flapper between an open position with respect to said distal end of said main pipe and a closed position with respect to said distal end of said main pipe;

wherein said vehicle exhaust pipe is adapted to be cut thereby forming a hole in its elongated tubular body; and wherein said proximal end of said pipe exhaust cut-out is adapted to be connected to said vehicle exhaust pipe, and surrounding said hole, to thereby allow exhaust from said vehicle exhaust pipe to pass into and controllably out of said pipe exhaust cut-out.

15. The pipe exhaust cut-out of claim 14, wherein said distal end of said main pipe is flared outwardly and said inner surface thereof is adapted to contact said beveled edge of said rim of said main body portion of said flapper.

16. The pipe exhaust cut-out of claim 15, wherein said beveled edge of said rim is formed at an angle to said rim between 10 and 70 degrees.

17. The pipe exhaust cut-out of claim 16, wherein said beveled edge of said rim is formed at an angle to said rim of 45 degrees.

18. The pipe exhaust cut-out of claim 15, wherein said beveled edge of said rim is formed having a curved cross section adapted to match the curved shape of the flare of said distal end of said main pipe.

19. The pipe exhaust cut-out of claim 14, wherein said actuator is formed as a linear electric actuator that includes an electric motor.

20. The pipe exhaust cut-out of claim 14, wherein said actuator includes a receiver adapted to receive electronic signals from a transmitter, such that said actuator can be controlled remotely via said transmitter.

* * * * *